US008690538B2

(12) United States Patent
Levine et al.

(10) Patent No.: US 8,690,538 B2
(45) Date of Patent: Apr. 8, 2014

(54) LEADING EDGE COOLING USING CHEVRON TRIP STRIPS

(75) Inventors: Jeffrey R. Levine, Vernon, CT (US); William Abdel-Messeh, Middletown, CT (US); Eleanor Kaufman, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 1201 days.

(21) Appl. No.: 11/473,894

(22) Filed: Jun. 22, 2006

(65) Prior Publication Data

US 2007/0297917 A1 Dec. 27, 2007

(51) Int. Cl.
*F01D 5/18* (2006.01)
*F01D 9/06* (2006.01)

(52) U.S. Cl.
USPC ..... 416/96 R; 416/97 R; 415/115

(58) Field of Classification Search
USPC ..... 415/115, 116; 416/96 R, 96 A, 97 R, 416/97 A, 232, 233
See application file for complete search history.

(56) References Cited

U.S. PATENT DOCUMENTS

| | | | | | |
|---|---|---|---|---|---|
| 4,257,737 | A | * | 3/1981 | Andress et al. | 416/97 R |
| 4,514,144 | A | * | 4/1985 | Lee | 416/96 R |
| 4,775,296 | A | * | 10/1988 | Schwarzmann et al. | 416/97 R |
| 5,052,889 | A | * | 10/1991 | Abdel-Messeh | 416/97 R |
| 5,232,343 | A | * | 8/1993 | Butts | 416/97 R |
| 5,246,340 | A | * | 9/1993 | Winstanley et al. | 416/97 R |
| 5,431,537 | A | * | 7/1995 | Sturm | 416/97 R |
| 5,681,144 | A | * | 10/1997 | Spring et al. | 416/97 R |
| 5,695,321 | A | * | 12/1997 | Kercher | 416/97 R |
| 5,700,132 | A | * | 12/1997 | Lampes et al. | 416/97 R |
| 6,068,445 | A | | 5/2000 | Beeck et al. | |
| 6,089,826 | A | * | 7/2000 | Tomita et al. | 416/96 R |
| 6,406,260 | B1 | * | 6/2002 | Trindade et al. | 416/96 R |
| 2005/0025623 | A1 | * | 2/2005 | Botrel et al. | 416/97 R |

FOREIGN PATENT DOCUMENTS

WO WO 2004/029416 A1 * 4/2004 ..... F01D 5/18

* cited by examiner

*Primary Examiner* — Christopher Verdier

(74) *Attorney, Agent, or Firm* — Bachman & LaPointe, P.C.

(57) ABSTRACT

A turbine engine component has an airfoil portion having a leading edge, a suction side, and a pressure side and a radial flow leading edge cavity through which a cooling fluid flows for cooling the leading edge. The turbine engine component further has a first set of trip strips and a second set of trip strips which meet at the leading edge nose portion of the leading edge cavity to form a plurality of chevron shaped trip strips and for generating a vortex in the leading edge cavity which impinges on the nose portion of the leading edge cavity and enhances convective heat transfer.

6 Claims, 2 Drawing Sheets

LEADING EDGE COOLING USING CHEVRON TRIP STRIPS

BACKGROUND (1) Field of the Invention

The present invention relates to enhanced cooling of the leading edge of airfoil portions of turbine engine components using chevron shaped trip strips that meet at the nose of the leading edge cavity.

(2) Prior Art

Due to the extreme environment in which they are used, some turbine engine components, such as blades and vanes, are cooled. A variety of different cooling techniques have been employed. One such scheme is illustrated in FIG. 1 where there is shown an airfoil portion 10 of a turbine engine component 12. As can be seen from the figure, a radial flow leading edge cavity 14 is used to effect cooling of the leading edge region.

Despite the existence of such a cooling scheme, there remains a need for improving the cooling of the leading edge of the airfoil portions of turbine engine components.

SUMMARY OF THE INVENTION

Accordingly, it is an aim of the present invention to provide enhanced cooling for the leading edge of airfoil portions of turbine engine components.

In accordance with the present invention, a turbine engine component broadly comprises an airfoil portion having a leading edge, a suction side, and a pressure side, a radial flow leading edge cavity through which a cooling fluid flows for cooling the leading edge, and means for generating a vortex in the leading edge cavity which impinges on a nose portion of the leading edge cavity. The vortex generating means comprises a first set of trip strips and a second set of trip strips which meet at the leading edge nose portion.

Other details of the leading edge cooling using chevron trip strips of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
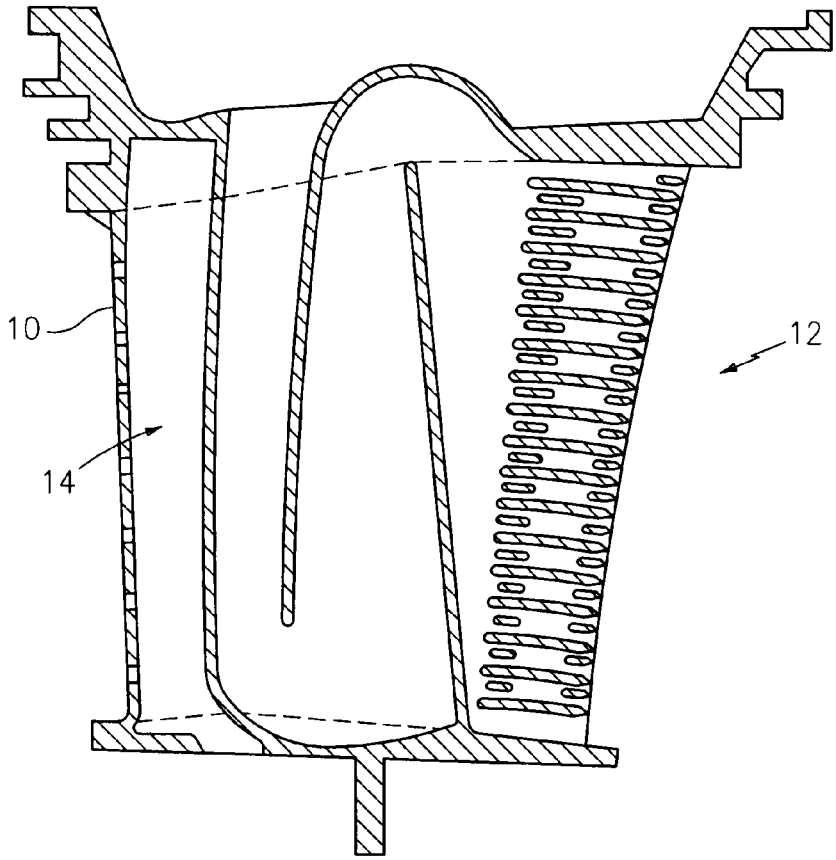
FIG. 1 (PRIOR ART)
FIG. 1 illustrates a prior art turbine engine component having a radial flow leading edge cavity.
Figure 2:
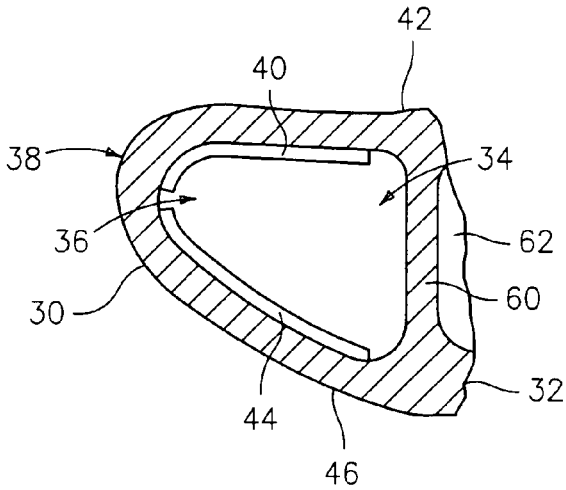
FIG. 2 illustrates a cross-section of a leading edge portion of an airfoil used in a turbine engine component having two sets of trip strips.

Referring now to the drawings, FIG. 2 illustrates the leading edge 30 of an airfoil portion 32 of a turbine engine component. As can be seen from this figure, the leading edge 30 has a leading edge cavity 34 in which a cooling fluid, such as engine bleed air, flows in a radial direction. The leading edge 30 also has a nose portion 36 and an external stagnation region 38.

It has been found that trip strips are desirable to provide adequate cooling of the leading edge 30, especially at the nose portion 36 of the airfoil portion 32 adjacent to the external stagnation region 38. The trip strip arrangement which will be discussed hereinafter provides high heat transfer to the leading edge 30 of the airfoil portion 32.

Figure 5:
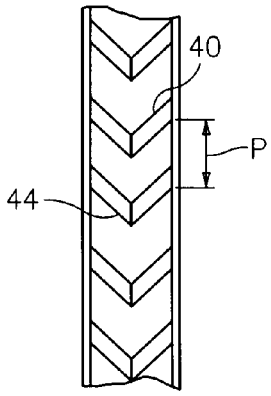
FIG. 5 illustrates the placement of the leading edge of the trip strips.
Figure 7:
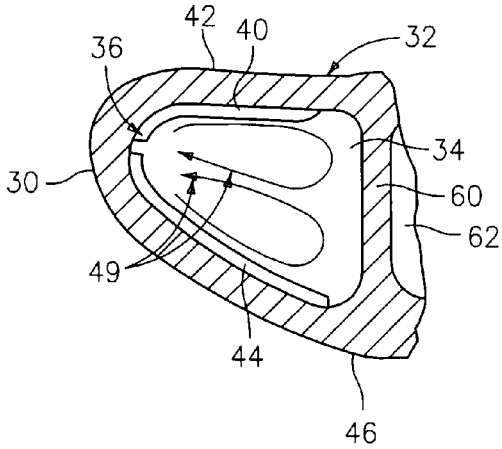
FIG. 7 illustrates the vortex generated in the leading edge cavity.

As shown in FIGS. 2-4 and 6, a plurality of trip strips 40 are positioned on the pressure side 42 of the airfoil portion 32, while a plurality of trip strips 44 are placed on the suction side 46 of the airfoil portion 32. The parallel trip strips 40 and the parallel trip strips 44 each extend in a direction 48 of flow in the leading edge cavity 34. The trip strips 40 on the pressure side 42 meet the trip strips 44 on the suction side 46 at the leading edge nose portion 36 and create a chevron shape as shown in FIG. 5. As cooling air passes over the thus oriented trip strips 40, the flow is tripped and generates a large vortex 49 at the leading edge (see FIG. 7). This large vortex 49 generates very high heat transfer coefficients at the leading edge nose 36.

Figure 3:
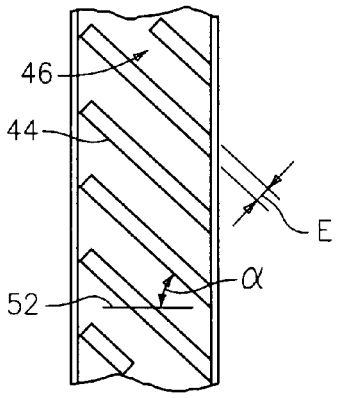
FIG. 3 illustrates the trip strips on the suction side of the leading edge portion.
Figure 4:
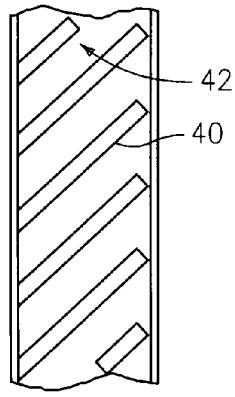
FIG. 4 illustrates the trip strips on the pressure side of the leading edge portion.
Figure 6:
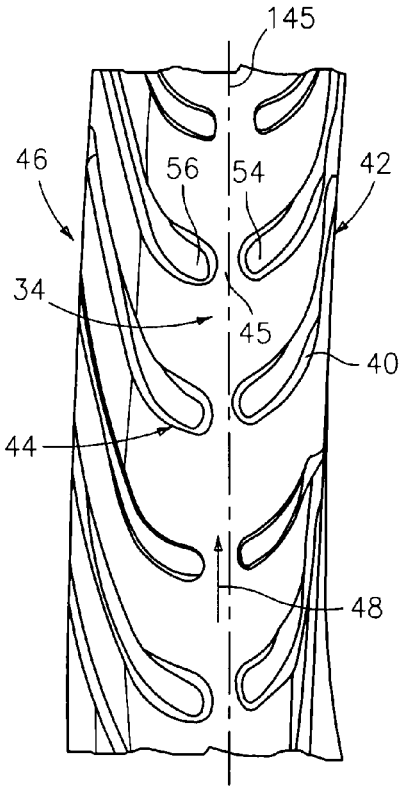
FIG. 6 is a three dimensional view of the trip strips.

The orientation of the trip strips 40 and 44 in the cavity 34 also increases heat transfer at the leading edge of the airfoil portion 32. As shown in FIGS. 3 and 4, the trip strips 40 and 44 may be oriented at an angle $\alpha$ of approximately 45 degrees relative to an engine centerline 52. The leading edges 54 and 56 of the trip strips 40 and 44 are positioned in the region of highest heat load, in this case the leading edge nose 36. This trip strip orientation permits the creation of the turbulent vortex 49 in the cavity 34. The flow initially hits the leading edge of the trip strip and separates from the airfoil surface. The flow then re-attaches downstream of the trip strip leading edge and moves toward the divider rib 60 between the leading edge cavity 34 and the adjacent cavity 62. As the flow approaches the divider rib 60, it is forced toward the opposite airfoil wall. The flow is being directed perpendicular to the pressure side and suction side walls 42 and 46, and meets at the center of the cavity 34. The flow is now forced back towards the leading edge 30 of the airfoil portion 32. The result of this flow migration causes the large vortex 49 that drives flow into the leading edge of the cavity 34, acting as an impingement jet which also enhances heat transfer at the leading edge nose 36.

Using the trip strip configuration of the present invention, radial flowing leading edge cavities of turbine engine components will see an increase in convective heat transfer at the leading edge nose of the cavity.

The particular orientation of the trip strip configuration allows for cooling flow to impinge on the leading edge nose 36, further enhancing heat transfer. The leading edges of the trip strips 40 and 44 are located at the nose 36 of the leading edge cavity 34.

If desired, the leading edges of the trip strips 40 and 44 may be separated by a gap 45. The gap 45 may be maintained at a distance up to five times the height of the trip strips 40 or 44. When a plurality of the trip strips 40 and 44 are positioned along the pressure and suction side walls of the airfoil portion, a plurality of gaps 45 are located along a parting line 145 of the airfoil portion.

The trip strip configuration of the present invention maintains a P/E ratio between 3.0 and 25 where P is the radial pitch (distance) between adjacent trip strips and E is trip strip height. Further, the trip strip configuration described herein maintains an E/H ratio of between 0.15 and 1.50 where E is trip strip height and H is the height of the cavity 34.

It is apparent that there has been provided in accordance with the present invention leading edge cooling using chevron trip strips which fully satisfies the objects, means, and advantages set forth hereinbefore. While the present invention has been described in the context of specific embodiments thereof, other unforeseeable alternatives, modifications, and variations may become apparent to those skilled in the art having read the foregoing detailed description. Accordingly, it is intended to embrace those alternatives, modifications, and variations as fall within the broad scope of the appended claims.

What is claimed is:

1. A turbine engine component comprising:

an airfoil portion having a leading edge, a suction side, and a pressure side;

a radial flow leading edge cavity through which a cooling fluid flows for cooling said leading edge;

a first set of trip strips and a second set of trip strips which meet at the leading edge nose portion for generating a vortex in said leading edge cavity which impinges on the nose portion of said leading edge cavity;

said first set of trip strips being non-staggered with respect to said second set of trip strips; and each of said trip strips in said first set and each of said trip strips in said second set being oriented at an angle of approximately 45 degrees relative to an engine centerline and having a curved leading edge portion which conforms to a curvature of the leading edge of the airfoil portion, wherein leading edges of said first trip strips are separated from leading edges of said second trip strips by a plurality of gaps, wherein each said gap is maintained at a distance up to five times the height of each said trip strip, and wherein each of said trip strips has an E/H ratio between 0.15 and 1.50 where E is the trip strip height and H is the height of the cavity.

2. The turbine engine component according to claim 1, wherein said first set of trip strips comprises a plurality of parallel trip strips extending in a direction of flow in said leading edge cavity.

3. The turbine engine component according to claim 1, wherein said second set of trip strips comprises a plurality of parallel trip strips extending in a direction of flow in said leading edge cavity.

4. The turbine engine component according to claim 1, wherein said plurality of gaps are located along a parting line of said airfoil portion.

5. The turbine engine component according to claim 1, wherein each of said trip strips has a leading edge and said leading edge of each of said trip strips is positioned in a region of highest heat load.

6. The turbine engine component according to claim 1, wherein each of said trip strips has a P/E ratio in the range of from 3.0 to 25 where P is a radial pitch between adjacent trip strips and E is the trip strip height.

* * * * *